US009199464B2

(12) United States Patent
Shimomura

(10) Patent No.: US 9,199,464 B2
(45) Date of Patent: Dec. 1, 2015

(54) INKJET PRINTER WITH OFFSET INK NOZZLE ARRAY

(71) Applicant: RISO KAGAKU CORPORATION, Tokyo (JP)

(72) Inventor: Kenji Shimomura, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/467,067

(22) Filed: Aug. 25, 2014

(65) Prior Publication Data

US 2015/0062247 A1 Mar. 5, 2015

(30) Foreign Application Priority Data

Aug. 29, 2013 (JP) ..... 2013-178056

(51) Int. Cl.
*B41J 2/21* (2006.01)
*B41J 2/155* (2006.01)

(52) U.S. Cl.
CPC ..... *B41J 2/155* (2013.01); *B41J 2/2132* (2013.01); *B41J 2/2146* (2013.01)

(58) Field of Classification Search
CPC ..... B41J 2/155; B41J 2/2132; B41J 2/2146
USPC ..... 347/43, 40, 41, 14, 15, 78
See application file for complete search history.

(56) References Cited

U.S. PATENT DOCUMENTS 7,399,058 B2 * 7/2008 Ikegame ..... 347/41
8,011,756 B2 * 9/2011 Ike et al. ..... 347/43

FOREIGN PATENT DOCUMENTS

JP 2010274449 A 12/2010

* cited by examiner

*Primary Examiner* — Henok Legesse
(74) *Attorney, Agent, or Firm* — Greenblum & Bernstein P.L.C.

(57) ABSTRACT

Each of a plurality of head modules of a first inkjet head includes a black nozzle array configured to eject a black ink and a cyan nozzle array configured to eject a cyan ink. A plurality of nozzles of the cyan nozzle array and a plurality of nozzles of the black nozzle array are offset by a half pitch in a main scanning direction. Each of a plurality of head modules of at least one second inkjet head other than the first inkjet head includes a magenta nozzle array configured to eject a magenta ink and a yellow nozzle array configured to eject a yellow ink.

15 Claims, 9 Drawing Sheets

INKJET PRINTER WITH OFFSET INK NOZZLE ARRAY

CROSS REFERENCE TO RELATED APPLICATION

This application is based upon and claims the benefit of priority from the prior Japanese Patent Application No. 2013-178056, filed on Aug. 29, 2013, the entire contents of which are incorporated herein by reference.

BACKGROUND

1. Technical Field

This disclosure relates to an inkjet printer configured to perform printing by ejecting ink from an inkjet head to a sheet.

2. Related Art

A line inkjet printer is known which performs printing by ejecting ink from a fixed inkjet head to a sheet while transferring the sheet.

A line inkjet printer described in Japanese Unexamined Patent Application Publication No. 2010-274449 has a type of inkjet head formed of multiple head modules arranged in a zigzag pattern along a main scanning direction orthogonal to a transfer direction (sub-scanning direction) of a sheet. Each of the head modules is provided with a nozzle array formed of multiple nozzles arranged along the main scanning direction.

In this type of inkjet head, for example, when an ink ejection failure which cannot be recovered occurs in the inkjet head, it is only necessary to replace the failed head module. Accordingly, this type of inkjet head has excellent maintainability. Moreover, this type of inkjet head has such an advantage that sheets of various sizes can be handled by simply changing the number of head modules.

SUMMARY

In a normal color printer, recording materials (inks and the like) of black, cyan, magenta, and yellow are used. In a line inkjet printer, inkjet heads respectively ejecting the black, cyan, magenta, and yellow inks are arranged along the sub-scanning direction.

In the aforementioned type of line inkjet printer, the inkjet heads of the respective colors are each formed of multiple head modules configured to eject the ink of the corresponding color. Generally, it is considered that the head modules should be arranged in such a way that the ejected inks of the respective colors land at the same position in each of pixels.

The head modules are attached to a head holder. Accurately adjusting the positions of the head modules such that the inks of the respective colors land at the same position in each of the pixels requires many attachment steps and a great cost and is thus difficult.

Accordingly, attachment positions of the head modules in the main scanning direction are misaligned in some cases in a head module array. Moreover, the way the head modules are misaligned may vary from one head module array to another. Here, each of the head module arrays is formed of the head modules of the respective colors arranged in the same row along the sub-scanning direction.

When the way the head modules are misaligned varies from one head module array to another, a dot pattern formed of the inks of the respective colors which have landed on the sheet varies and the color of the printed image may differ from one head module array to another.

Particularly, in a gray image formed of mixed colors of the black, cyan, magenta, and yellow inks, the color of the image greatly changes depending on a positional relationship of dots of these colors and differences in color among the head module arrays tend to be visible. Due to this, print quality of the gray image deteriorates in some cases.

An object of the present invention is to provide an inkjet printer which can suppress deterioration in print quality of a mixed-color gray image.

An inkjet printer in accordance with some embodiments includes a transfer unit configured to transfer a sheet in a transfer direction and a head unit configured to perform printing by ejecting ink to the sheet transferred by the transfer unit. The head unit includes a plurality of inkjet heads arranged along the transfer direction and each including a plurality of head modules arranged along a main scanning direction orthogonal to the transfer direction. Each of the plurality of head modules includes at least one nozzle array including a plurality of nozzles configured to eject ink and arranged along the main scanning direction at a pitch. Each of the plurality of head modules of a first inkjet head of the plurality of inkjet head includes a black nozzle array including the plurality of nozzles configured to eject a black ink and a cyan nozzle array including the plurality of nozzles configured to eject a cyan ink. The plurality of nozzles of the cyan nozzle array is offset from the plurality of nozzles of the black nozzle array by a half of the pitch in the main scanning direction. Each of the plurality of head modules of at least one second inkjet head of the plurality of inkjet heads other than the first inkjet head includes a magenta nozzle array including the plurality nozzles configured to eject a magenta ink and a yellow nozzle array including the plurality of nozzles configured to eject a yellow ink.

In the configuration described above, the black nozzle array and the cyan nozzle array are arranged in the same head module with the positions of the nozzles being offset from one another by a half pitch in the main scanning direction. This can suppress change in the color of mixed-color gray even in the case where the positions of the magenta dots and the yellow dots are misaligned in the main scanning direction with respect to the black dots and the cyan dots due to attachment position misalignment of the head modules. Accordingly, even when the way the head modules are misaligned varies from one head module array to another which are formed along the transfer direction, change in the color of the mixed-color gray among the head module arrays is suppressed. As a result, the deterioration of print quality of a mixed-color gray image can be suppressed.

The at least one second inkjet head may be a single inkjet head. In each of the plurality of head modules of the single inkjet head, the plurality of nozzles of the magenta nozzle array and the plurality of nozzles of the yellow nozzle array may be offset from one another by a half of the pitch in the main scanning direction. The single inkjet head may be configured to eject the inks to form magenta and yellow dots at intermediate positions in the transfer direction between dot positions of black and cyan dots formed by the first inkjet head.

In the configuration described above, the magenta nozzle array and the yellow nozzle array are arranged in each of the head modules of the same inkjet head with the positions of the nozzles being offset from each other by a half pitch in the main scanning direction. Moreover, the inkjet head provided with the magenta nozzle arrays and the yellow nozzle arrays ejects the inks to form the magenta and yellow dots at intermediate positions between dot positions of black and cyan dots in the transfer direction. This can suppress overlapping of the dots of these colors to a small degree. Accordingly, even when there is misalignment of the nozzles between the head modules in the main scanning direction, change in the color of a printed image can be suppressed. As a result deterioration of the print quality can be suppressed.

DETAILED DESCRIPTION

Figure 1:
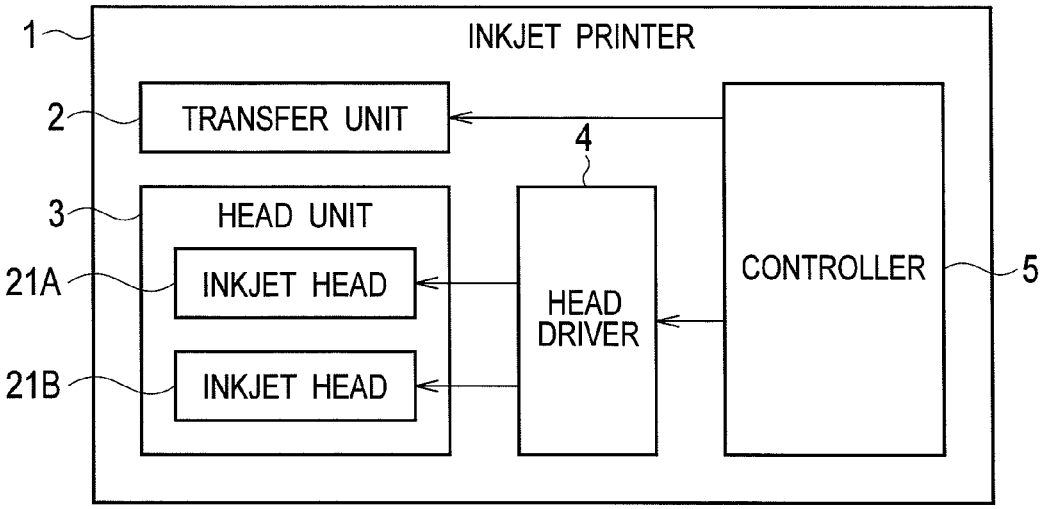
FIG. 1 is a block diagram showing a configuration of an inkjet printer in an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
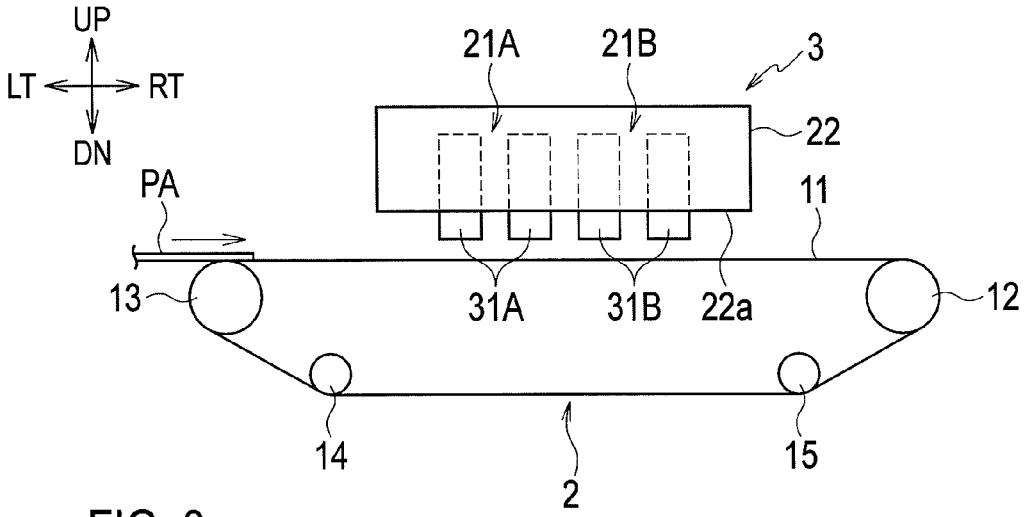
FIG. 2 is a schematic configuration diagram of a transfer unit and a head unit.
Figure 3:
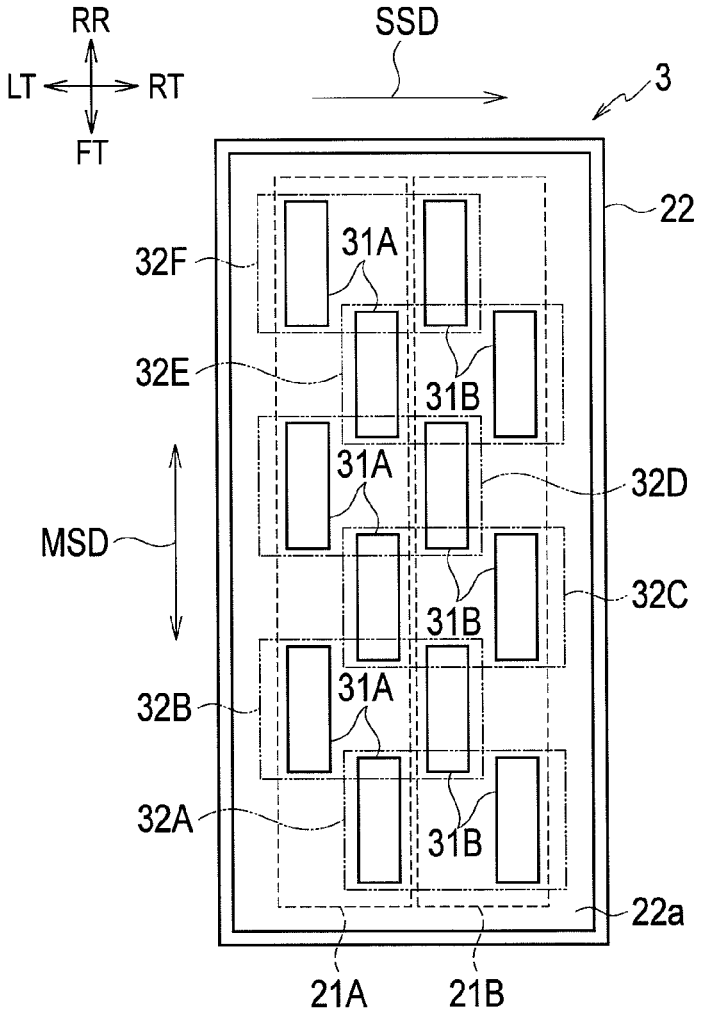
FIG. 3 is a plan view of the head unit.
Figure 4:
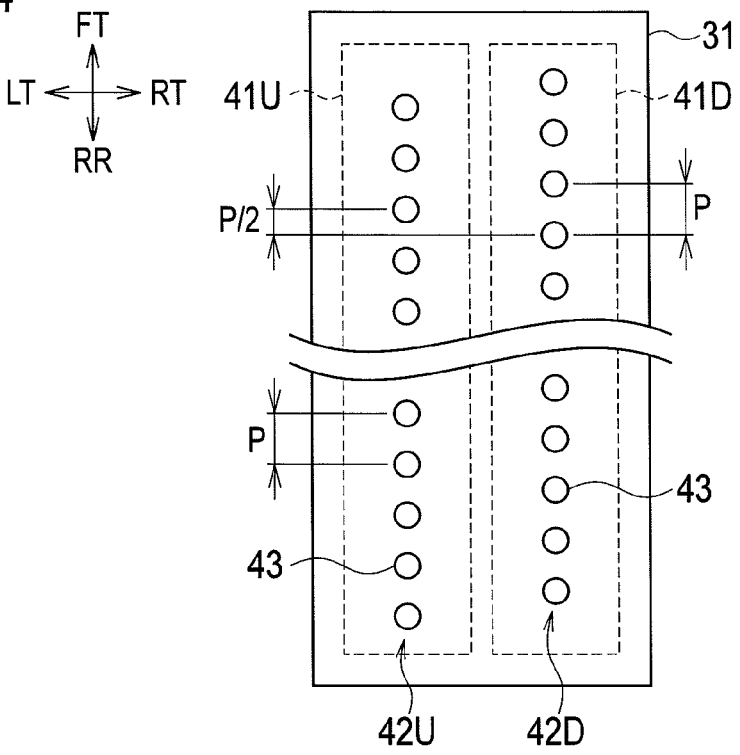
FIG. 4 is a schematic configuration diagram of a head module.

FIG. 1 is a block diagram showing a configuration of an inkjet printer in an embodiment of the present invention. FIG. 2 is a schematic configuration diagram of a transfer unit and a head unit of the inkjet printer shown in FIG. 1. FIG. 3 is a plan view of the head unit. FIG. 4 is a schematic configuration diagram of a head module.

In the following description, a direction orthogonal to a sheet surface of FIG. 2 assumed to be front-rear direction (main scanning direction) and a direction toward the front of the sheet surface is assumed to be a frontward direction. Moreover, up, down, left, and right in the sheet surface of FIG. 2 are assumed to be upward, downward, leftward, and rightward directions, respectively. In FIG. 2, a direction from left to right is a transfer direction (sub-scanning direction) of the sheet PA. In the following description, upstream and downstream mean upstream and downstream in the transfer direction. In the drawings, the rightward direction, the leftward direction, the upward direction, the downward direction, the frontward direction, and the rearward direction are denoted by RT, LT, UP, DN, FT, and RR, respectively. Moreover, in the drawings, the transfer direction (sub-scanning direction) of the sheet PA and the front-rear direction (main scanning direction) are denoted by SSD and MSD, respectively.

As shown in FIG. 1, an inkjet printer 1 of the embodiment includes a transfer unit 2, a head unit 3, a head driver 4, and a controller 5.

The transfer unit 2 transfers the sheet PA. As shown in FIG. 2, the transfer unit 2 includes a transfer belt 11, a drive roller 12, and driven rollers 13, 14, 15.

The transfer belt 11 transfers the sheet PA while sucking and holding the sheet PA. The transfer belt 11 is an annular belt wound around the drive roller 12 and the driven rollers 13 to 15. Many belt holes for sucking and holding the sheet PA are formed in the transfer belt 11. The transfer belt 11 sucks and holds the sheet PA on a top surface thereof by using sucking force generated at the belt holes by drive of a fan (not illustrated). The transfer belt 11 is rotated clockwise in FIG. 2 to transfer the sucked and held sheet PA rightward.

The drive roller 12 rotates the transfer belt 11. The drive roller 12 is driven by a not-illustrated motor.

The driven rollers 13 to 15 are driven by the drive roller 12 via the transfer belt 11. The driven roller 13 is disposed on the left side of the drive roller 12 at substantially the same height as the drive roller 12. The driven rollers 14, 15 are disposed below the drive roller 12 and the driven roller 13 at substantially the same height while being spaced away from each other in the left-right direction.

The head unit 3 prints an image by ejecting inks to the sheet PA transferred by the transfer unit 2. The head unit 3 is disposed above the transfer unit 2. The head unit 3 includes inkjet heads 21A, 21B and a head holder 22.

The inkjet heads 21A, 21B are line inkjet heads and eject the inks to the sheet PA transferred by the transfer unit 2. As will be described later, the inkjet head 21A ejects black (K) and cyan (C) inks. The inkjet head 21B ejects magenta (M) and yellow (Y) inks. The inkjet heads 21A, 21B are arranged in this order from the upstream side at a predetermined interval in the transfer direction (left-right direction) of the sheet PA.

The inkjet head 21A has multiple head modules 31A and the inkjet head 21B has multiple head modules 31B. In the embodiment, as shown in FIG. 3, the inkjet head 21A has six head modules 31A and the inkjet head 21B has six head modules 31B. Note that the inkjet heads 21A, 21B and the head modules 31A, 31B are described generally in some cases by omitting the alphabet letters attached to the reference numerals.

In each of the inkjet heads 21, the six head modules 31 are arranged in a zigzag pattern along the front-rear direction (main scanning direction) orthogonal to the transfer direction (sub-scanning direction) of the sheet PA. Specifically, the six head modules 31 are arranged along the front-rear direction with the positions thereof being alternately offset in the left-right direction. In other words, in the head unit 3, the six head modules 31A and the six head modules 31B are arranged to form six head module arrays 32A, 32B, 32C, 32D, 32E, 32F. The head module arrays 32A to 32F each include the head modules 31A, 31B of the same row in the transfer direction (sub-scanning direction) of the sheet PA. Note that the head module arrays 32A to 32F are described generally in some cases by omitting the alphabet letters attached to the reference numerals.

Each of the head modules 31 ejects inks of two colors. As shown in FIG. 4, the head module 31 has two ink chambers 41U, 41D and two nozzle arrays 42U, 42D. FIG. 4 is a bottom view of the head module 31. Note that the ink chambers 41U, 41D and the nozzle arrays 42U, 42D are described generally in some cases by omitting the alphabet letters attached to the reference numerals.

The ink chambers 41 store the inks. The inks are supplied to the ink chambers 41 through ink passages (not illustrated). Piezoelectric elements (not illustrated) are disposed in the ink chambers 41. The inks are ejected from later-described nozzles 43 by drive of the piezoelectric elements.

The black (K) ink is supplied to the ink chamber 41U of each head module 31A. The cyan (C) ink is supplied to the ink chamber 41D of each head module 31A. The magenta (M) ink is supplied to the ink chamber 41U of each head module 31B. The yellow (Y) ink is supplied to the ink chamber 41D of each head module 31B.

The nozzle arrays 42U, 42D are arranged parallel to each other in the left-right direction (sub-scanning direction). Each of the nozzle arrays 42 includes multiple nozzles 43 configured to eject the ink. In the head modules 31, the number of droplets (droplet number) of the ink ejected from one nozzle 43 for one pixel can be changed to perform gradation printing in which density is expressed by the number of droplets.

In each of the nozzle arrays 42, the multiple nozzles 43 are arranged along the main scanning direction at equal intervals at a predetermined pitch P (front-rear direction). Moreover, the nozzles 43 of the upstream nozzle array 42U and the nozzles 43 of the downstream nozzle array 42D are arranged to be offset from one another by a half pitch (P/2) in the main scanning direction which is the arrangement direction of the nozzles 43. The nozzles 43 are opened on a bottom surface of each head module 31.

The nozzles 43 of the upstream nozzle array 42U (black nozzle array) of each head module 31A eject the black ink supplied to the ink chamber 41U of the head module 31A. The nozzles 43 of the downstream nozzle array 42D (cyan nozzle array) of each head module 31A eject the cyan ink supplied to the ink chamber 41D of the head module 31A.

The nozzles 43 of the upstream nozzle array 42U (magenta nozzle array) of each head module 31B eject the magenta ink supplied to the ink chamber 41U of the head module 31B. The nozzles 43 of the downstream nozzle array 42D (yellow nozzle array) of each head module 31B eject the yellow ink supplied to the ink chamber 41D of the head module 31B.

The head holder 22 holds the head modules 31. The head holder 22 is formed in a substantially rectangular solid shape which is hollow. The head holder 22 is disposed above the transfer unit 2. Multiple opening portions (not illustrated) to which the head modules 31 are respectively attached are formed on a bottom surface 22*a* of the head holder 22 at predetermined positions. The head holder 22 holds the head modules 31 with lower end portions of the head modules 31 protruding downward from the opening portions.

The head driver 4 drives the inkjet heads 21. Specifically, the head driver 4 drives the piezoelectric elements in the ink chambers 41 of the head modules 31 and causes the inks to be ejected from the nozzles 43.

The controller 5 controls operations of various parts of the inkjet printer 1. The controller 5 includes a CPU, a RAM, a ROM, a hard disk drive, and the like.

Next, description is given of operations of the inkjet printer 1.

When an instruction to start printing is given, the controller 5 causes the drive roller 12 of the transfer unit 2 to be rotationally driven. This causes the transfer belt 11 to rotate. When the sheet PA is fed from a not-illustrated paper feeder, the transfer unit 2 transfers the sheet PA. The controller 5 causes the inks to be ejected from the inkjet heads 21A, 21B to the sheet PA transferred by the transfer unit 2 on the basis of image data. An image is thereby printed on the sheet PA. The printed sheet PA is discharged by a not-illustrated paper discharge unit.

In the inkjet printer 1, a mixed-color gray image is formed in some cases by using the black, cyan, magenta, and yellow inks.

In the mixed-color gray image, dots of each color are formed of a small droplet amount (droplet number) of ink. This is because otherwise the concentration becomes too high and a color of gray cannot be obtained.

In an apparatus in which, unlike the inkjet printer 1 of the embodiment, inkjet heads of respective colors of black, cyan, magenta, and yellow are provided and each inkjet head is formed of multiple head modules arranged in a zigzag pattern, the head modules are generally arranged such that the positions of nozzles configured to eject the inks of the respective colors coincide with each other in the main scanning direction.

Figure 5:
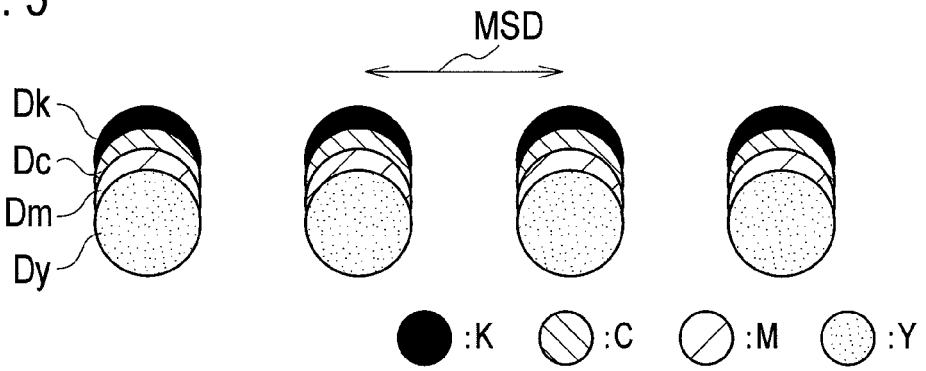
FIG. 5 is a view showing a dot image in a mixed-color gray image formed by an apparatus in which the positions of nozzles configured to eject inks of certain colors coincide with each other in a main scanning direction.

When a mixed-color gray image is formed in such an apparatus, the dots of each color are formed by using a small droplet amount (droplet numbers) of ink as described above. Accordingly, as shown in FIG. 5, a white space is formed between the dots. Note that, although black dots Dk, cyan dots Dc, magenta dots Dm, and yellow dots Dy which are formed to overlap one another are illustrated in FIG. 5 in a manner offset from one another for the sake of visibility, these dots are actually formed at the same position.

Figure 6:
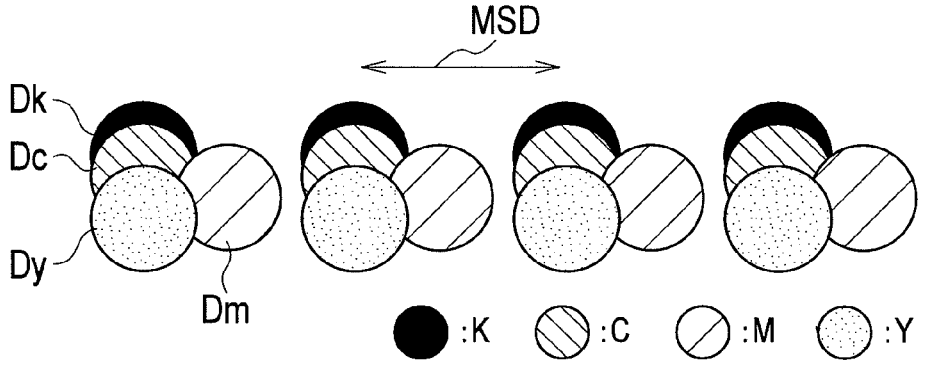
FIG. 6 is a view showing an example of a dot image of a mixed-color gray image in which change in color occurs due to misalignment of the nozzles.

When the nozzles are misaligned due to attachment position misalignment between the head modules in an apparatus like one described above, a color is added to the mixed-color gray. For example, when the positions of the nozzles configured to eject the magenta ink are misaligned from the original positions in the main scanning direction, as shown in FIG. 6, the magenta dots Dm are formed at the positions misaligned in the main scanning direction with respect to the dots Dk, Dc, Dy of the other colors. The magenta dots Dm are thus formed in spaces which should be white spaces. As a result, a gray image which should be neutral in color becomes reddish.

When the way the head modules are misaligned varies from one head module array to another which are formed along the sub-scanning direction, the color of the gray image generated as described above may vary from one head module array to another. As a result, the color of the gray image may differ among the head module arrays.

Meanwhile, in the inkjet printer 1 of the embodiment, the nozzle array 42U configured to eject the black ink and the nozzle array 42D configured to eject the cyan ink are disposed in the same head module 31A. Moreover, in the head module 31A, the nozzle array 42U and the nozzle array 42D are arranged to be offset from one another by a half pitch.

Figure 7:
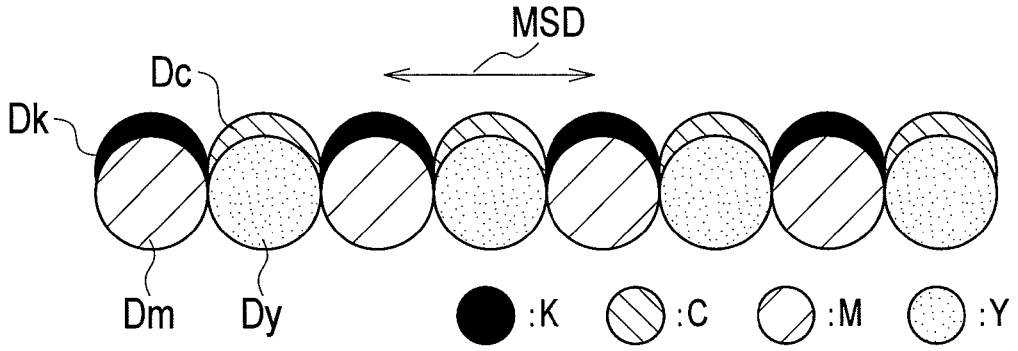
FIG. 7 is a view showing a dot image of a mixed-color gray image formed by the inkjet printer of the embodiment.

Accordingly, as shown in FIG. 7, the mixed-color gray image is filled with the black dots Dk and the cyan dots Dc with almost no white space in the main scanning direction. Moreover, forming the dots Dk, Dc of black and cyan, which are colors with low lightness among the four colors, at positions offset from one another by a half pitch causes the color of the mixed-color gray to be less affected by the positions of the dots Dm, Dy of the other colors in the main scanning direction.

The change in the color of the mixed-color gray can be thereby suppressed even when the magenta dots Dm and the yellow dots Dy are misaligned in the main scanning direction with respect to the black dots Dk and the cyan dots Dc due to attachment position misalignment between the head modules 31A, 31B. Accordingly, even when the way the head modules 31A, 31B are misaligned varies from one head module array 32 to another, change in the color of the mixed-color gray among the head module arrays 32 can be suppressed.

Figure 8:
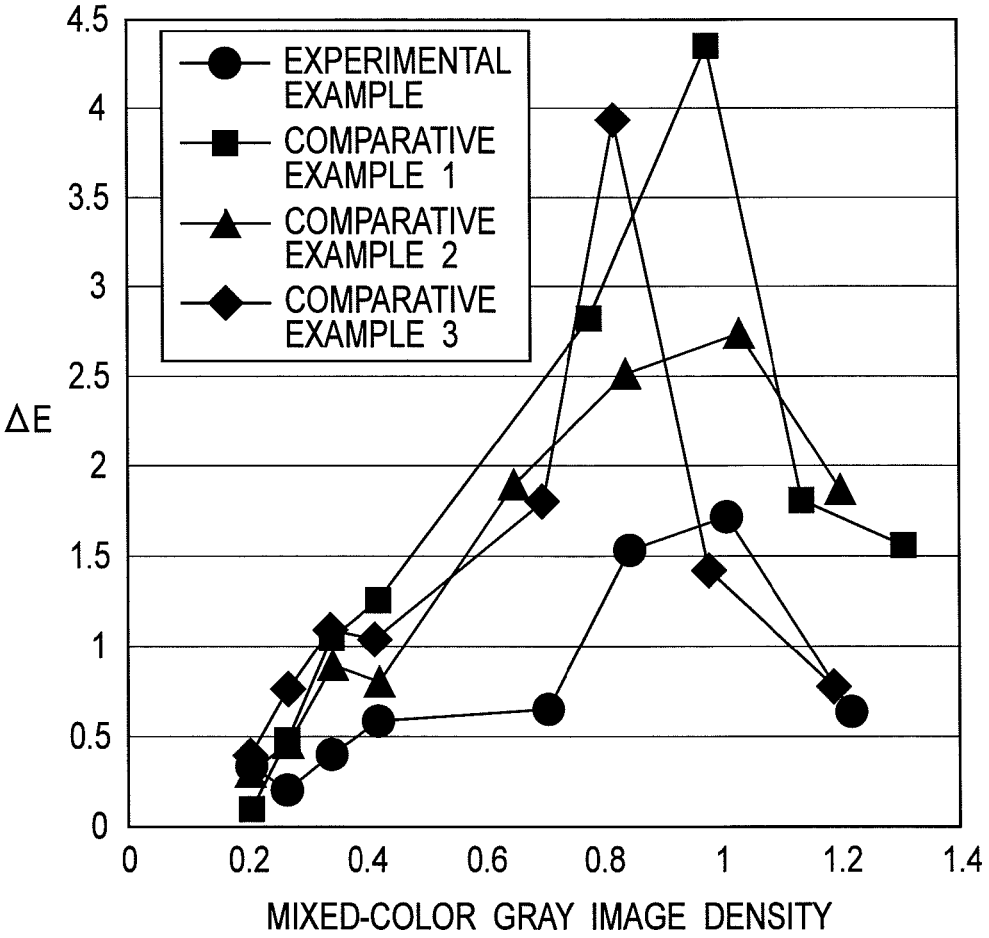
FIG. 8 is a view showing experimental results confirming effects of the misalignment of the nozzles, which is caused by attachment position misalignment between the head modules, on the color of the mixed-color gray.

FIG. 8 shows experimental results confirming effects of misalignment of the nozzles 43, which is caused by attachment position misalignment between the head modules 31, on the color of the mixed-color gray.

In the experimental example shown in FIG. 8, calculation is performed to obtain a color difference ΔE of a mixed-color gray image between a case where there is no misalignment of the nozzles 43 between the head modules 31A, 31B and a case where the degree of misalignment is greatest in the inkjet printer 1 of the embodiment. Specifically, values of L*, a*, b* of the mixed-color gray image in each of the case where there is no misalignment of the nozzles 43 between the head modules 31A, 31B and the case where the degree of misalignment is greatest are obtained by using a chromatometer, and the color difference ΔE is calculated from the obtained values by using a publicly-known color difference formula. The color difference ΔE is calculated for mixed-color gray images of various densities.

Figure 9A:
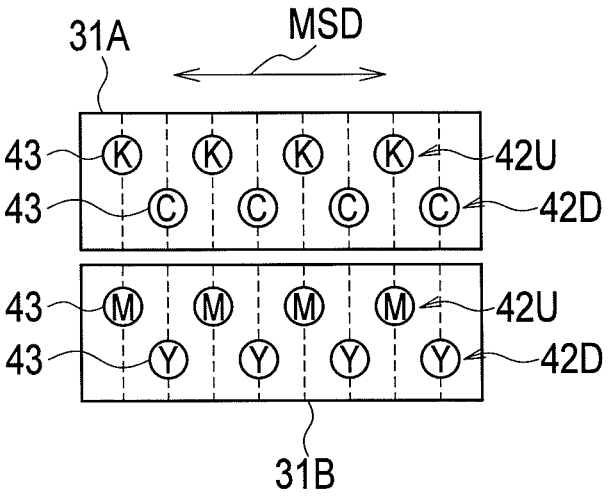
FIG. 9A is a view showing a positional relationship of the nozzles in a case where there is no misalignment of the nozzles between the head modules in an experimental example.

The positional relationship among the nozzles 43 of these colors is as shown in FIG. 9A in the case where there is no misalignment of the nozzles 43 between the head modules 31A, 31B in this experimental example. Specifically, the black (K) nozzles 43 and the magenta (M) nozzles 43 are at the same positions in the main scanning direction. Moreover, the cyan (C) nozzles 43 and the yellow (Y) nozzles 43 are at the same positions in the main scanning direction. The black nozzles 43 and the cyan nozzles 43 are at positions offset from one another by a half pitch.

Figure 9B:
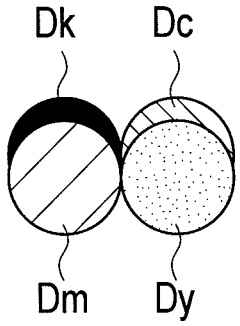
FIG. 9B is a view showing a dot pattern of the mixed-color gray image in the case where there is no misalignment of the nozzles between the head modules in the experimental example.

Due to the positional relationship of the nozzles 43 as shown in FIG. 9A, a dot pattern as shown in FIG. 9B is formed in the mixed-color gray image in the case where there is no misalignment of the nozzles 43 in the experimental example. Specifically, the black dot Dk and the cyan dot Dc are formed at positions offset from each other by a half pitch and the magenta dot Dm and the yellow dot Dy are formed at the same positions as the black dot Dk and the cyan dot Dc, respectively.

Figure 10A:
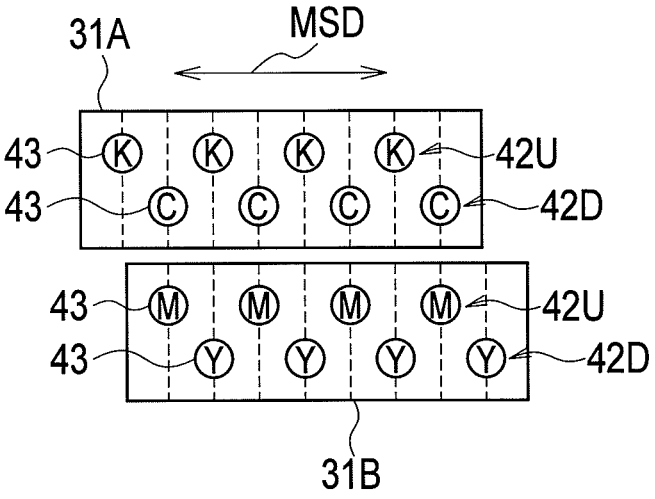
FIG. 10A is a view showing a positional relationship of the nozzles in a case where the degree of misalignment of the nozzles between the head modules is greatest in the experimental example.

Meanwhile, the positional relationship of the nozzles 43 of these colors is as shown in FIG. 10A in the case where the degree of misalignment of the nozzles 43 is greatest in the experimental example. In the inkjet printer 1, for each of the head module arrays 32, the nozzles 43 of the respective colors to be used for printing on the same pixel are selected in such a way that the degree of misalignment, in the main scanning direction, of the nozzles 43 corresponding to the pixel becomes smallest. Accordingly, a situation where the degree of misalignment of the nozzles 43 is greatest is a situation as shown in FIG. 10A where the nozzles 43 are misaligned from one another by a half pitch compared to the situation of FIG. 9A.

Figure 10B:
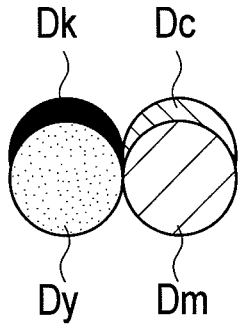
FIG. 10B is a view showing a dot pattern of the mixed-color gray image in the case where the degree of misalignment of the nozzles between the head modules is greatest in the experimental example.

Due to the positional relationship of the nozzles 43 as shown in FIG. 10A, a dot pattern as shown in FIG. 10B is formed in the mixed-color gray image in the case where the degree of misalignment of the nozzles 43 is greatest in the experimental example. Specifically, the black dot Dk and the cyan dot Dc are formed at positions offset from each other by a half pitch and the yellow dot Dy and the magenta dot Dm are formed at the same positions as the black dot Dk and the cyan dot Dc, respectively.

Next, in a comparative example 1 of FIG. 8, a configuration is such that the black dots Dk and the magenta dots Dm are always formed at positions offset from one another by a half pitch in the main scanning direction. Specifically, the nozzle arrays 42U, 42D of each head module 31A are configured to eject the cyan and yellow inks, respectively, and the nozzle arrays 42U, 42D of each head module 31B are configured to eject the magenta and black inks, respectively. A color difference ΔE between a case where there is no misalignment of the nozzles 43 between the head modules 31A, 31B and a case where the degree of misalignment is greatest is calculated for mixed-color gray images of various densities in this configuration.

Figure 11A:
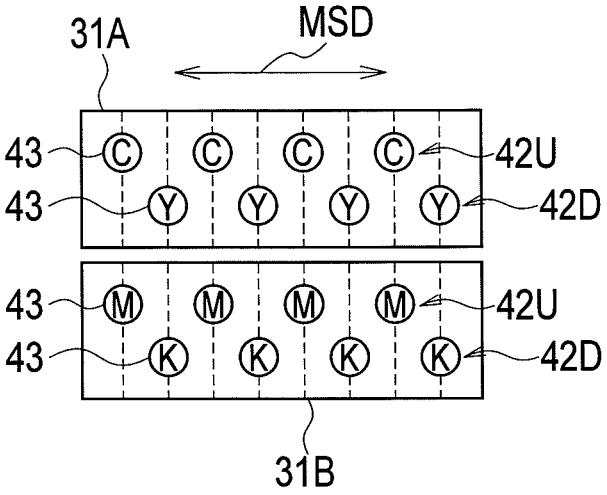
FIG. 11A is a view showing a positional relationship of the nozzles in a case where there is no misalignment of the nozzles between the head modules in a comparative example 1.

The positional relationship among the nozzles 43 of these colors is as shown in FIG. 11A in the case where there is no misalignment of the nozzles 43 between the head modules 31A, 31B in the comparative example 1. Specifically, the cyan nozzles 43 and the magenta nozzles 43 are at the same positions in the main scanning direction. Moreover, the yellow nozzles 43 and the black nozzles 43 are at the same positions in the main scanning direction. The black nozzles 43 and the magenta nozzles 43 are at positions offset from one another by a half pitch.

Figure 11B:
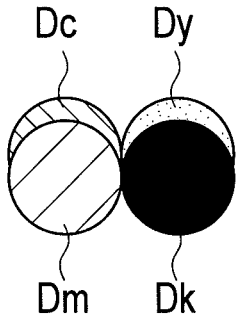
FIG. 11B is a view showing a dot pattern of the mixed-color gray image in the case where there is no misalignment of the nozzles between the head modules in the comparative example 1.

Due to the positional relationship of the nozzles 43 as shown in FIG. 11A, a dot pattern as shown in FIG. 11B is formed in the mixed-color gray image in the case where there is no misalignment of the nozzles 43 in the comparative example 1. Specifically, the magenta dot Dm and black dot Dk are formed at the same positions as the cyan dot Dc and the yellow dot Dy, respectively. The black dot Dk and the magenta dot Dm are formed at positions offset from each other by a half pitch.

Figure 12A:
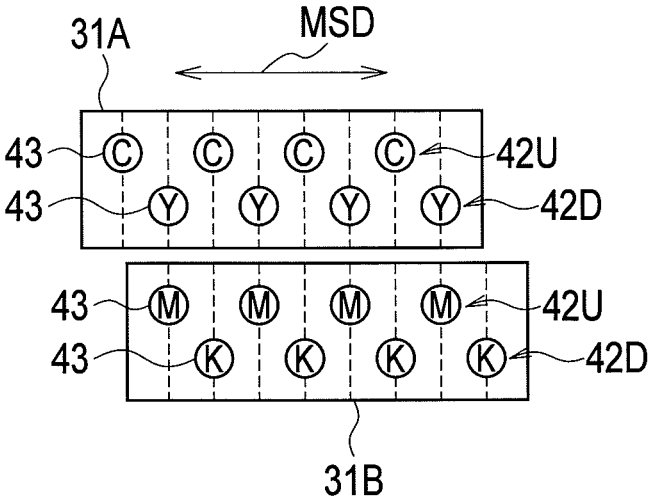
FIG. 12A is a view showing a positional relationship of the nozzles in a case where the degree of misalignment of the nozzles between the head modules is greatest in the comparative example 1.

Meanwhile, the positional relationship of the nozzles 43 of these colors is as shown in FIG. 12A in the case where the degree of misalignment of the nozzles 43 is greatest in the comparative example 1. A situation where the degree of misalignment of the nozzles 43 is greatest is a situation as shown in FIG. 12A where the nozzles 43 are misaligned from one another by a half pitch compared to the situation of FIG. 11A.

Figure 12B:
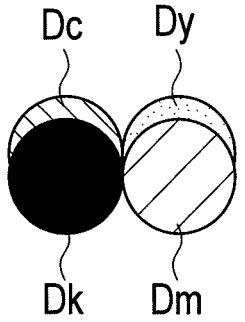
FIG. 12B is a view showing a dot pattern of the mixed-color gray image in the case where the degree of misalignment of the nozzles between the head modules is greatest in the comparative example 1.

Due to the positional relationship of the nozzles 43 as shown in FIG. 12A, a dot pattern as shown in FIG. 12B is formed in the mixed-color gray image in the case where the degree of misalignment of the nozzles 43 is greatest in the comparative example 1. Specifically, the magenta dot Dm and the black dot Dk are formed at the same positions as the yellow dot Dy and the cyan dot Dc, respectively. The black dot Dk and the magenta dot Dm are formed at positions offset from each other by a half pitch.

Next, in a comparative example 2 of FIG. 8, a configuration is such that the black dots Dk and the yellow dots Dy are always formed at positions offset from one another by a half pitch in the main scanning direction. Specifically, the nozzle arrays 42U, 42D of each head module 31A are configured to eject the black and yellow inks, respectively, and the nozzle arrays 42U, 42D of the head module 31B are configured to eject the magenta and cyan inks, respectively. A color difference ΔE between a case where there is no misalignment of the nozzles 43 between the head modules 31A, 31B and a mixed-color gray image in a case where the degree of misalignment is greatest is calculated for mixed-color gray images of various densities in this configuration.

Figure 13A:
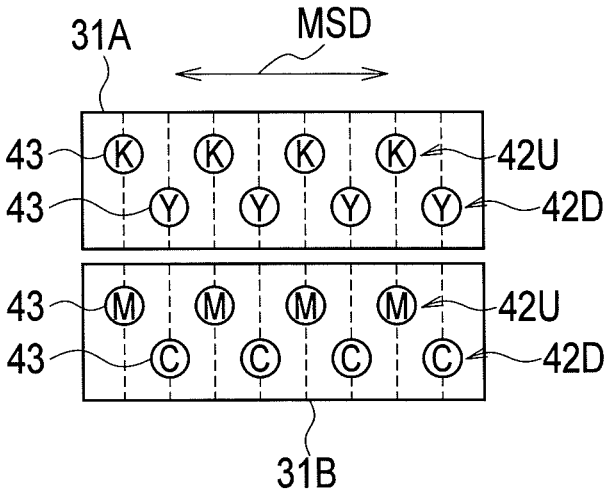
FIG. 13A is a view showing a positional relationship of the nozzles in a case where there is no misalignment of the nozzles between the head modules in a comparative example 2.

The positional relationship among the nozzles 43 of these colors is as shown in FIG. 13A in the case where there is no misalignment of the nozzles 43 between the head modules 31A, 31B in the comparative example 2. Specifically, the black nozzles 43 and the magenta nozzles 43 are at the same positions in the main scanning direction. Moreover, the yellow nozzles 43 and the cyan nozzles 43 are at the same positions in the main scanning direction. The black nozzles 43 and the yellow nozzles 43 are at positions offset from one another by a half pitch.

Figure 13B:
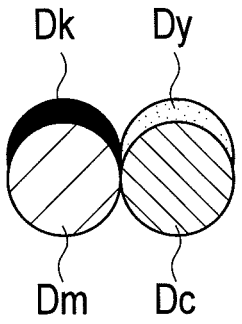
FIG. 13B is a view showing a dot pattern of the mixed-color gray image in the case where there is no misalignment of the nozzles between the head modules in the comparative example 2.

Due to the positional relationship of the nozzles 43 as shown in FIG. 13A, a dot pattern as shown in FIG. 13B is formed in the mixed-color gray image in the case where there is no misalignment of the nozzles 43 in the comparative example 2. Specifically, the black dot Dk and the yellow dot Dy are formed at positions offset from each other by a half pitch and the magenta dot Dm and the cyan dot Dc are formed at the same positions as the black dot Dk and the yellow dot Dy, respectively.

Figure 14A:
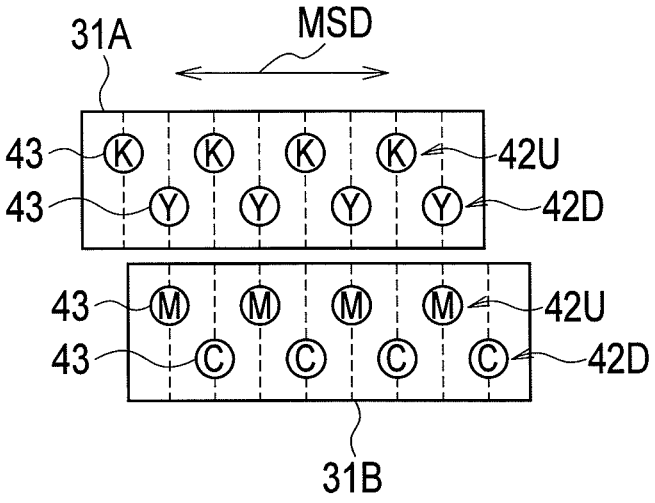
FIG. 14A is a view showing a positional relationship of the nozzles in a case where the degree of misalignment of the nozzles between the head modules is greatest in the comparative example 2.

Meanwhile, the positional relationship of the nozzles 43 of these colors is as shown in FIG. 14A in the case where the degree of misalignment of the nozzles 43 is greatest in the comparative example 2. A situation where the degree of misalignment of the nozzles 43 is greatest is a situation as shown in FIG. 14A where the nozzles 43 are misaligned from one another by a half pitch compared to the situation of FIG. 13A.

Figure 14B:
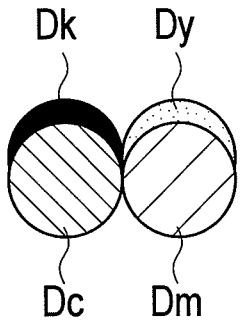
FIG. 14B is a view showing a dot pattern of the mixed-color gray image in the case where the degree of misalignment of the nozzles between the head modules is greatest in the comparative example 2.

Due to the positional relationship of the nozzles 43 as shown in FIG. 14A, a dot pattern as shown in FIG. 14B is formed in the mixed-color gray image in the case where the degree of misalignment of the nozzles 43 is greatest in the comparative example 2. Specifically, the black dot Dk and the yellow dot Dy are formed at positions offset from each other by a half pitch and the cyan dot Dc and the magenta dot Dm are formed at the same positions as the black dot Dk and the yellow dot Dy, respectively.

Next, in a comparative example 3 in FIG. 8, there is used an apparatus in which inkjet heads are provided for respective colors of black, cyan, magenta, and yellow and each of the inkjet heads includes multiple head modules arranged in a zigzag pattern. In this apparatus, a color difference ΔE between a case where there is no misalignment of the nozzles 43 of these colors and a case where the degree of misalignment of the magenta and yellow nozzles 43 with respect to the black and cyan nozzles 43 is greatest is calculated for mixed-color gray images of various densities in this apparatus.

Figure 15A:
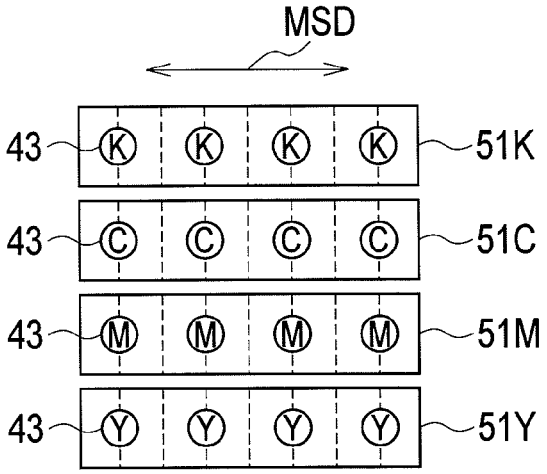
FIG. 15A is a view showing a positional relationship of the nozzles in a case where there is no misalignment of the nozzles of certain colors in a comparative example 3.

The positional relationship among the nozzles 43 of these colors is as shown in FIG. 15A in the case where there is no misalignment of the nozzles 43 of these colors in the apparatus of the comparative example 3. Here, sets of black, cyan, magenta, and yellow nozzles 43 are provided respectively in head modules 51K, 51C, 51M, 51Y corresponding to the respective colors.

Figure 15B:
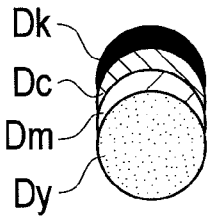
FIG. 15B is a view showing a dot pattern of the mixed-color gray image in the case where there is no misalignment of the nozzles of the certain colors in the comparative example 3.

Due to the positional relationship of the nozzles 43 as shown in FIG. 15A, a dot pattern as shown in FIG. 15B is formed in the mixed-color gray image in the case where there is no misalignment of the nozzles 43 in the comparative example 3. Specifically, the dots Dk, Dc, Dm, Dy of the respective colors are formed at the same position.

Figure 16A:
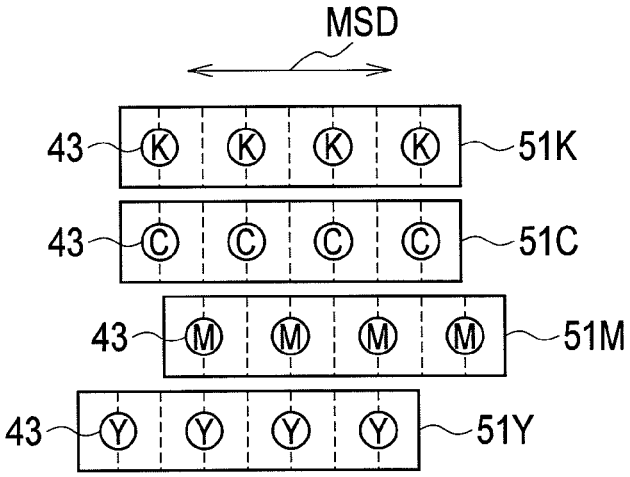
FIG. 16A is a view showing a positional relationship of the nozzles in a case where the degree of misalignment of magenta and yellow nozzles with respect to black and cyan nozzles is greatest in the comparative example 3.

Meanwhile, the positional relationship of the nozzles 43 of these colors is as shown in FIG. 16A in the case where the degree of misalignment of the magenta and yellow nozzles 43 with respect to the black and cyan nozzles 43 is greatest in the comparative example 3. A situation where the degree of misalignment of the magenta and yellow nozzles 43 with respect to the black and cyan nozzles 43 is greatest is a situation as shown in FIG. 16A where the magenta and yellow nozzles 43 are misaligned by a half pitch with respect to the black and cyan nozzles 43.

Figure 16B:
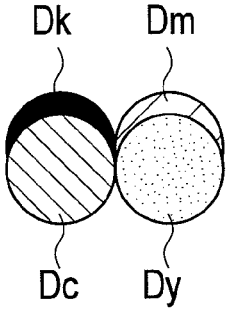
FIG. 16B is a view showing a dot pattern of the mixed-color gray image in the case where the degree of misalignment of the magenta and yellow nozzles with respect to the black and cyan nozzles is greatest in the comparative example 3.

Due to the positional relationship of the nozzles 43 as shown in FIG. 16A, a dot pattern as shown in FIG. 16B is formed in the mixed-color gray image in the case where the degree of misalignment of the magenta and yellow nozzles 43 with respect to the black and cyan nozzles 43 is greatest in the comparative example 3. Specifically, the black dot Dk and the cyan dot Dc are formed at the same position and the magenta dot Dm and the yellow dot Dy are formed at a position offset from the black dot Dk and the cyan dot Dc by a half pitch.

As shown in FIG. 8, the color difference ΔE is suppressed to a small degree in the experimental example compared to the comparative examples 1 to 3.

The following fact is found from comparison between the experimental example and the comparative examples 1, 2. Specifically, change in the color of the mixed-color gray image due to misalignment of the nozzles 43 can be suppressed in the configuration in which the black and cyan dots Dk, Dc are always formed at positions offset from one another by a half pitch, compared to the configuration in which the black and magenta dots Dk, Dm are always formed at positions offset from one another by a half pitch and the configuration in which the black and yellow dots Dk, Dy are always formed at positions offset from one another by a half pitch.

Moreover, it is found from the comparison between the experimental example and the comparative example 3 that forming the black and cyan dots Dk, Dc at positions offset from one another by a half pitch can reduce effects of the positions of the dots Dm, Dy of the other colors than in the case where the dots Dk, Dc are formed at the same positions.

In the inkjet printer 1, in printing of the mixed-color gray image, the black and cyan inks with low lightness are ejected from each head module 31A to the transferred sheet and, as shown in FIG. 7, the black dots Dk and the cyan dots Dc are alternately formed in the main scanning direction without a gap. Next, the magenta and yellow inks with high lightness are ejected from each head module 31B and the magenta dots Dm and the yellow dots Dy are formed to overlap the dots Dk, Dc. Note that, like FIG. 9B, FIG. 7 is a dot image in the case where there is no misalignment of the nozzles 43 between the head modules 31A, 31B.

Here, the color of a portion where the dots of these colors overlap each other greatly affects the hue of the image. In the inkjet printer 1, a dot in which the dots Dk, Dm overlap each other and a dot in which the dots Dc, Dy overlap each other are formed in the case where there is no misalignment of the nozzles 43 as shown in FIGS. 7, 9A, and 9B. Both of these dots are dots in which a high-lightness color and a low-lightness color overlap each other, and a color difference between these dots is small. Meanwhile, a dot in which the dots Dk, Dy overlap each other and a dot in which the dots Dc, Dm overlap each other are formed in the case where the nozzles 43 are misaligned as shown in FIGS. 10A and 10B. Both of these dots are also dots in which a high-lightness color and a low-lightness color overlap each other, and a color difference between these dots is small. Moreover, a color difference between the colors of the following pixels is small: a single pixel formed of the dot in FIGS. 7 and 9B in which the dots Dk, Dm overlap each other and the dot in FIGS. 7 and 9B in which the dots Dc, Dy overlap each other; and a single pixel formed of the dot in FIGS. 10A and 10B in which the dots Dk, Dy overlap each other and the dot in FIGS. 10A and 10B in which the dots Dc, Dm overlap each other. As described above, in the inkjet printer 1, even in the case where there is misalignment of the nozzles 43 between the head modules 31A, 31B, the color of the mixed-color gray image does not change greatly from that in the case of no misalignment.

Meanwhile, for example, in the comparative example 2 shown in FIGS. 13A, 13B, 14A, and 14B, a dot in which the dots Dk, Dm overlap each other and a dot in which the dots Dy, Dc overlap each other are formed in the case where there is no misalignment of the nozzles 43 as in FIGS. 13A and 13B. Both of these dots are dots in which a high-lightness color and a low-lightness color overlap each other, and a color difference between these dots is small. Meanwhile, a dot in which the dots Dk, Dc overlap each other and a dot in which the dots Dy, Dm overlap each other are formed in the case where the nozzles 43 are misaligned as shown in FIGS. 14A and 14B. These dots are a dot in which high-lightness colors overlap each other and a dot in which low-lightness colors overlap each other, and the color difference between these dots is great. Moreover, a color difference between the colors of the following pixels is great: a single pixel formed of the dot in FIG. 13B in which the dots Dk, Dm overlap each other and the dot in FIG. 13B in which the dots Dy, Dc overlap each other; and a single pixel formed of the dot in FIG. 14B in which the dots Dk, Dc overlap each other and the dot in FIG. 14B in which the dots Dy, Dm overlap each other. As described above, in the comparative example 2, in the case where there is misalignment of the nozzles 43 between the head modules 31A, 31B, the color of the mixed-gray image greatly changes from that in the case of no misalignment. This is the same in the comparative examples 1 and 3.

From the facts described above, it can be said that forming the dots Dk, Dc of black and cyan which are low-lightness colors among the four colors at positions offset from each other by a half pitch can cause the color of the mixed-color gray image to be less affected by the misalignment of the nozzles 43 between the head modules 31A, 31B.

As described above, in the inkjet printer 1, the nozzle array 42U configured to eject the black ink and the nozzle array 42D configured to eject the cyan ink are disposed in the same head module 31A. Moreover, in the head module 31A, the nozzle array 42U and the nozzle array 42D are arranged such that the positions of the nozzles 43 are offset from one another by a half pitch. This can suppress change in the color of the mixed-color gray even in the case where the magenta dots Dm and the yellow dots Dy are misaligned in the main scanning direction with respect to the black dots Dk and the cyan dots Dc due to attachment position misalignment between the head modules 31A, 31B. Accordingly, even when the way the head modules 31A, 31B are misaligned varies from one head module array 32 to another, change in the color of the mixed-color gray among the head module arrays 32 can be suppressed. As a result, deterioration in print quality of the mixed-color gray image can be suppressed.

Note that, in the embodiment, description is given of the configuration in which the nozzle arrays configured to eject the magenta ink and the nozzle arrays configured to eject the yellow ink are disposed in the head modules of the same inkjet head. However, the configured may be such that these nozzle arrays are disposed in the head modules of separate inkjet heads. There is no need to arrange the nozzle arrays configured to eject the magenta ink and the nozzle arrays configured to eject the yellow ink with the positions of the nozzles being offset from one another by a half pitch in the main scanning direction. It is only necessary that the nozzle arrays configured to eject the magenta ink and the nozzle arrays configured to eject the yellow ink are provided in the head modules of an inkjet head other than the inkjet head provided with the nozzle arrays configured to eject the black ink and the nozzle arrays configured to eject the cyan ink.

Moreover, in the embodiment, each of the head modules 31A is configured such that the upstream nozzle array 42U ejects the black ink and the downstream nozzle array 42D ejects the cyan ink. However, the configuration may be such that the nozzle array 42U ejects the cyan ink and the nozzle array 42D ejects the black ink. Furthermore, the nozzle arrays configured to eject the magenta ink and the nozzle arrays configured to eject the yellow ink may each be disposed either upstream or downstream of the nozzle arrays configured to eject the black ink and the nozzle arrays configured to eject the cyan ink.

In the inkjet printer 1, the controller 5 may control ejection timings in such a way that the inkjet head 21B ejects the inks to form the magenta and yellow dots at intermediate positions between dot positions of black and cyan dots in the sub-scanning direction (transfer direction). The dots Dk, Dc, Dm, Dy of these colors are thereby formed as shown in FIG. 17.

In this case, the black dots Dk and the cyan dots Dc are formed to be offset from one another by a half pitch in the main scanning direction. Moreover, the magenta dots Dm and the yellow dots Dy are formed to be offset from one another by a half pitch. In the sub-scanning direction, the black dots Dk and the magenta dots Dm are formed to be arranged alternately and the cyan dots Dc and the yellow dots Dy are formed to be arranged alternately. Hence, the dots can be prevented from overlapping one another.

Here, the color of an image in a macro point of view depends on the average of colors in micro regions. If there is no overlapping of the dots, the average of colors in micro regions does not change even when a positional relationship among the dots of these colors changes in the micro regions, and the color in the macro point of view does not change. Meanwhile, if dots of different colors overlap one another, the average of the colors in the micro regions changes from that in the case where there is no overlapping. The color in the macro point of view thus also changes.

Figure 17:
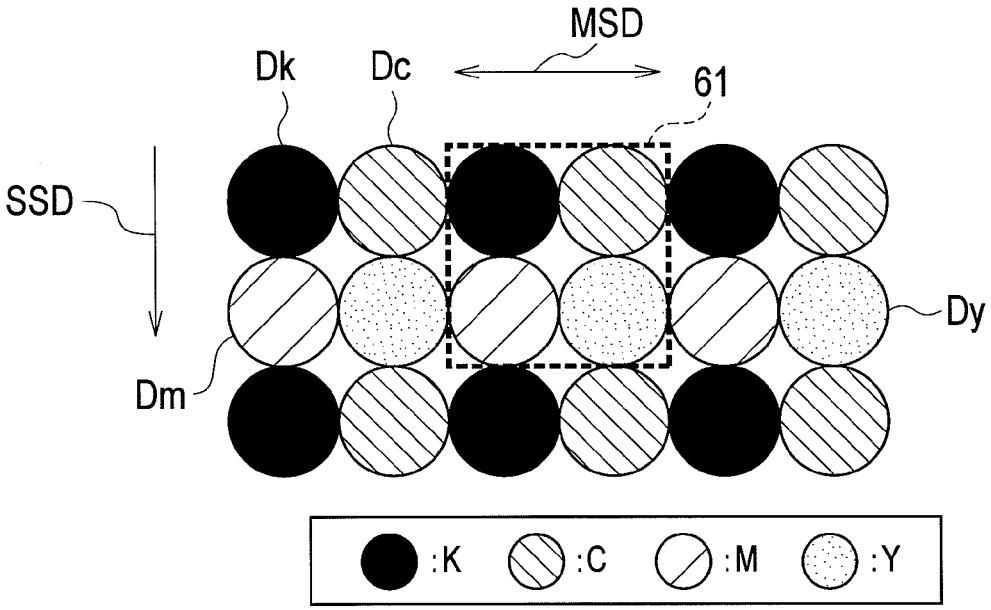
FIG. 17 is a view showing an example of a dot image in a case where magenta and yellow dots are formed at intermediate portions between dot positions of black and cyan dots in a sub-scanning direction.
Figure 18:
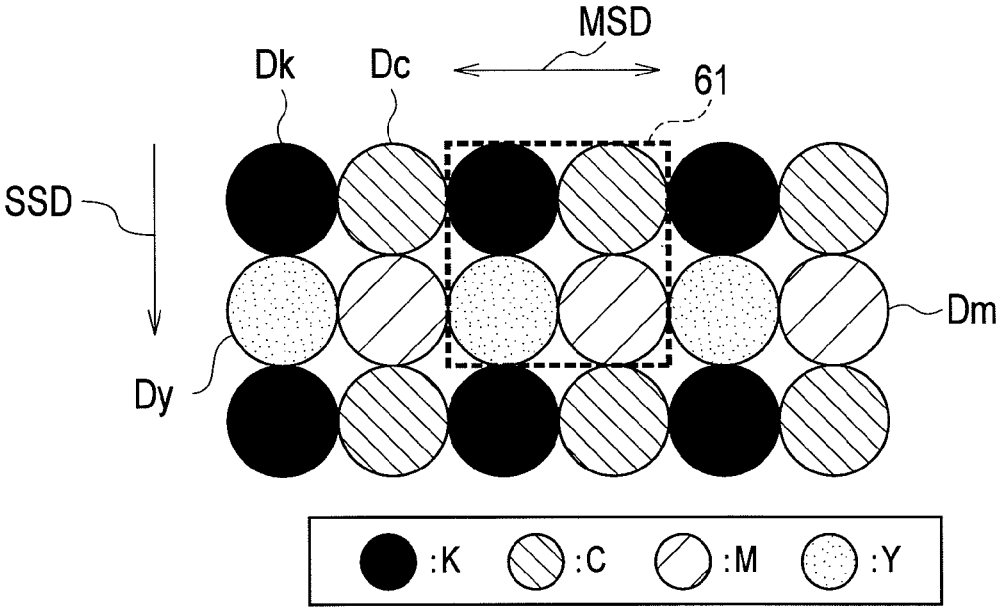
FIG. 18 is a view showing another example of the dot image in the case where the magenta and yellow dots are formed at the intermediate portions between the dot positions of the black and cyan dots in a sub-scanning direction.

FIG. 17 is the dot image of a printed image in the case where there is no misalignment of the nozzles 43 between the head modules 31A, 31B as shown in FIG. 9A. Meanwhile, when the ejection timings are controlled as described above in the case where the degree of misalignment of the nozzles 43 is greatest as shown in FIG. 10A, the dots of these colors are formed as shown in FIG. 18. In the image of FIG. 18, only the positional relationship among the dots Dk, Dc and the dots Dm, Dy in the main scanning direction differs from that in the image of FIG. 17 and there is no overlapping of the dots.

A micro region 61 in FIG. 18 differs from the micro region 61 in FIG. 17 only in the arrangement of the dots of the respective colors and the average of the colors is the same. Accordingly, there is no difference between the image of FIG. 17 and the image of FIG. 18 in terms of color in the macro point of view.

As described above, performing the aforementioned control of the ejection timings can suppress change in the color of the printed image even when there is misalignment of the nozzles 43 between the head modules 31A, 31B in the main scanning direction. Note that, even when the dots are large and overlap one another, the overlapping can be suppressed to a small degree and the effect on the color of the image can be thereby suppressed to a small degree. Hence, performing the aforementioned control of the ejection timings can suppress deterioration of the print quality not only in the mixed-color gray image but also in other types of images.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. An inkjet printer comprising:

a transfer unit configured to transfer a sheet in a transfer direction; and a print head configured to perform printing by ejecting ink to the sheet transferred by the transfer unit, wherein the print head comprises a plurality of inkjet heads arranged with respect to each other along the transfer direction and each including a plurality of head modules arranged with respect to each other along a main scanning direction orthogonal to the transfer direction, each of the plurality of head modules comprises at least two nozzle arrays each including a plurality of nozzles configured to eject ink and arranged with respect to each other along the main scanning direction at a predetermined pitch, each of the plurality of head modules of a first inkjet head of the plurality of inkjet heads comprises:

a black nozzle array including the plurality of nozzles configured to eject a black ink; and a cyan nozzle array including the plurality of nozzles configured to eject a cyan ink, the plurality of nozzles of the cyan nozzle array being offset from the plurality of nozzles of the black nozzle array by a half of the predetermined pitch in the main scanning direction, and each of the plurality of head modules of at least one second inkjet head of the plurality of inkjet heads other than the first inkjet head comprises:

a magenta nozzle array including the plurality nozzles configured to eject a magenta ink;

and a yellow nozzle array including the plurality of nozzles configured to eject a yellow ink.

2. The inkjet printer according to claim 1, wherein the at least one second inkjet head is a single inkjet head, in each of the plurality of head modules of the single inkjet head, the plurality of nozzles of the magenta nozzle array and the plurality of nozzles of the yellow nozzle array are offset from one another by a half of the predetermined pitch in the main scanning direction, and the single inkjet head is configured to eject the inks to form magenta and yellow dots at intermediate positions in the transfer direction between dot positions of the black and the cyan dots formed by the first inkjet head.

3. The inkjet printer according to claim 1, wherein the head module containing the black and cyan nozzles is in a different inkjet head than the head module containing the magenta and yellow nozzles.

4. The inkjet printer according to claim 1, wherein a major dimension of each inkjet head and of each head module extends in the main scanning direction.

5. The inkjet printer according to claim 1, wherein the plurality of inkjet heads are line inkjet heads fixedly positioned with respect to the transfer unit.

6. The inkjet printer according to claim 1, wherein head modules of each inkjet head are positioned at two different positions, in the transfer direction.

7. The inkjet printer according to claim 1, wherein head modules of each inkjet head are offset from each other in the transfer direction.

8. The inkjet printer according to claim 1, further comprising a print head holder configured to receive a plurality of inkjet heads.

9. The inkjet printer according to claim 1, wherein the head module containing the black and cyan nozzles is in a different inkjet head than the head module containing the magenta and yellow nozzles; wherein a major dimension of each inkjet head and of each head module extends in the main scanning direction.

10. The inkjet printer according to claim 1, wherein the head module containing the black and cyan nozzles is in a different inkjet head than the head module containing the magenta and yellow nozzles; wherein the plurality of inkjet heads are line inkjet heads fixedly positioned with respect to the transfer unit.

11. The inkjet printer according to claim 1, wherein the head module containing the black and cyan nozzles is in a different inkjet head than the head module containing the magenta and yellow nozzles; wherein a major dimension of each inkjet head and of each head module extends in the main scanning direction; wherein the plurality of inkjet heads are line inkjet heads fixedly positioned with respect to the transfer unit.

12. The inkjet printer according to claim 1, wherein the at least one second inkjet head is a single inkjet head, in each of the plurality of head modules of the single inkjet head, the plurality of nozzles of the magenta nozzle array and the plurality of nozzles of the yellow nozzle array are offset from one another by a half of the predetermined pitch in the main scanning direction, and the single inkjet head is configured to eject the inks to form magenta and yellow dots at intermediate positions in the transfer direction between dot positions of the black and the cyan dots formed by the first inkjet head;

wherein the head module containing the black and cyan nozzles is in a different inkjet head than the head module containing the magenta and yellow nozzles.

13. The inkjet printer according to claim 1, wherein the at least one second inkjet head is a single inkjet head, in each of the plurality of head modules of the single inkjet head, the plurality of nozzles of the magenta nozzle array and the plurality of nozzles of the yellow nozzle array are offset from one another by a half of the predetermined pitch in the main scanning direction, and the single inkjet head is configured to eject the inks to form magenta and yellow dots at intermediate positions in the transfer direction between dot positions of the black and the cyan dots formed by the first inkjet head;

wherein the head module containing the black and cyan nozzles is in a different inkjet head than the head module containing the magenta and yellow nozzles;

wherein a major dimension of each inkjet head and of each head module extends in the main scanning direction.

14. The inkjet printer according to claim 1, wherein the at least one second inkjet head is a single inkjet head, in each of the plurality of head modules of the single inkjet head, the plurality of nozzles of the magenta nozzle array and the plurality of nozzles of the yellow nozzle array are offset from one another by a half of the predetermined pitch in the main scanning direction, and the single inkjet head is configured to eject the inks to form magenta and yellow dots at intermediate positions in the transfer direction between dot positions of the black and the cyan dots formed by the first inkjet head;

wherein the head module containing the black and cyan nozzles is in a different inkjet head than the head module containing the magenta and yellow nozzles;

wherein the plurality of inkjet heads are line inkjet heads fixedly positioned with respect to the transfer unit.

15. The inkjet printer according to claim 1, wherein the at least one second inkjet head is a single inkjet head, in each of the plurality of head modules of the single inkjet head, the plurality of nozzles of the magenta nozzle array and the plurality of nozzles of the yellow nozzle array are offset from one another by a half of the predetermined pitch in the main scanning direction, and the single inkjet head is configured to eject the inks to form magenta and yellow dots at intermediate positions in the transfer direction between dot positions of the black and the cyan dots formed by the first inkjet head;

wherein the head module containing the black and cyan nozzles is in a different inkjet head than the head module containing the magenta and yellow nozzles;

wherein a major dimension of each inkjet head and of each head module extends in the main scanning direction;

wherein the plurality of inkjet heads are line inkjet heads fixedly positioned with respect to the transfer unit.

* * * * *